US011828103B1

(12) United States Patent
Johnson et al.

(10) Patent No.: US 11,828,103 B1
(45) Date of Patent: Nov. 28, 2023

(54) DOOR ASSEMBLY WITH REMOVABLE LOCKBOX

(71) Applicant: WireCrafters, LLC, Louisville, KY (US)

(72) Inventors: Erik Johnson, Bardstown, KY (US); Brandon Green, Shepherdsville, KY (US)

(73) Assignee: WireCrafters, LLC, Louisville, KY (US)

( * ) Notice: Subject to any disclaimer, the term of this patent is extended or adjusted under 35 U.S.C. 154(b) by 301 days.

(21) Appl. No.: 17/100,152

(22) Filed: Nov. 20, 2020

Related U.S. Application Data

(60) Provisional application No. 62/939,740, filed on Nov. 25, 2019.

(51) Int. Cl.
*E06B 11/02* (2006.01)
*E05B 9/08* (2006.01)
*E05B 65/00* (2006.01)

(52) U.S. Cl.
CPC ..... *E06B 11/021* (2013.01); *E05B 9/08* (2013.01); *E05B 65/0007* (2013.01)

(58) Field of Classification Search
CPC ... E05B 9/08; E05B 9/02; E05B 63/08; E05B 63/0056; E05B 17/2084; E05B 17/2003; E05B 17/0205; E05B 15/0205; E06B 11/021; E06B 65/0007
See application file for complete search history.

(56) References Cited

U.S. PATENT DOCUMENTS 1,423,825 A * 7/1922 Anderson ..... E05B 9/08 70/451
1,483,333 A * 2/1924 Capece ..... E05B 63/08 70/451
2,178,132 A * 10/1939 Anderson ..... E05B 63/006 70/450
3,513,674 A * 5/1970 Rutherford ..... E05B 9/00 70/451
3,594,031 A * 7/1971 Ford ..... E05B 65/0811 70/100
3,673,605 A * 6/1972 Allenbaugh ..... E05B 17/2084 70/451
4,139,999 A * 2/1979 Allenbaugh ..... E05B 17/2084 70/448
4,456,290 A * 6/1984 Gross ..... E05B 65/0025 292/DIG. 53
4,696,174 A * 9/1987 Marks ..... E05B 9/08 70/462

(Continued)

*Primary Examiner* — Justin B Rephann
(74) *Attorney, Agent, or Firm* — Stites & Harbison, PLLC; David W. Nagle, Jr.; Gary N. Stewart

(57) ABSTRACT

A door assembly is configured to accept various lockboxes and locking mechanisms. The door assembly includes: a door with a cavity defined along an outer edge of the door; a lockbox that is positioned within the cavity and is removably secured to the door; and a locking mechanism that is carried by the lockbox. The lockbox includes various openings of different types, which are spaced to accommodate different types of locking mechanisms. The lockbox can be removed from the door to either replace the locking mechanism carried by the lockbox or to substitute the lockbox altogether to modify the locking features and/or functionality of the door assembly as desired or needed.

18 Claims, 7 Drawing Sheets

(56) References Cited

U.S. PATENT DOCUMENTS 4,875,725 A * 10/1989 Marks ..... E05B 65/0811 70/462
4,887,856 A * 12/1989 Percoco ..... E05B 15/0205 292/264
5,404,737 A * 4/1995 Hotzl ..... E05B 47/0012 70/279.1
5,406,814 A * 4/1995 Zeager ..... E05B 17/2088 292/346
5,586,796 A * 12/1996 Fraser ..... E05B 15/0205 292/357
5,599,006 A * 2/1997 Gevaux ..... E01F 13/022 256/25
5,634,508 A * 6/1997 Herbst ..... E06B 3/7001 160/369
5,743,057 A * 4/1998 Martin ..... E06B 3/7003 49/501
5,802,765 A * 9/1998 Vickery ..... E05B 17/2084 49/67
5,845,439 A * 12/1998 Hendley ..... E06B 1/30 49/501
5,906,493 A * 5/1999 Bishop ..... G09B 9/00 292/357
6,112,471 A * 9/2000 Welch ..... E05B 63/0056 70/451
6,196,034 B1 * 3/2001 Diebold ..... E05B 17/2084 70/95
6,481,158 B1 * 11/2002 Marks ..... E05B 63/246 49/141
6,581,333 B2 * 6/2003 Kimball ..... E05B 65/0017 49/504
6,679,533 B1 * 1/2004 Bruner ..... E05B 15/0205 292/346
6,688,063 B1 * 2/2004 Lee ..... E05B 9/08 70/141
6,837,082 B1 * 1/2005 Moore ..... E06B 5/11 70/108
7,121,531 B1 * 10/2006 Gonzalez ..... E05B 65/0007 256/73
7,971,394 B1 * 7/2011 Dowling ..... E06B 3/70 49/506
8,006,527 B2 * 8/2011 Nowakowski ..... E05B 65/0007 292/346
8,197,257 B2 * 6/2012 Clewis ..... A62B 5/00 434/226
9,187,926 B2 * 11/2015 Machacek ..... E04H 17/163
9,790,716 B2 * 10/2017 Hagemeyer ..... E05B 65/0858
10,415,267 B1 * 9/2019 Schmutz ..... E05B 1/0015
10,550,605 B2 * 2/2020 Perdue ..... E05B 63/0065
11,248,398 B2 * 2/2022 Sullivan ..... E05B 55/00
2003/0084616 A1 * 5/2003 Kimball ..... E05B 9/02 49/504
2011/0113835 A1 * 5/2011 Nowakowski ..... E05B 17/2003 70/91
2015/0204134 A1 * 7/2015 Wong ..... E06B 5/11 292/307 B
2016/0108650 A1 * 4/2016 Hagemeyer ..... E05C 3/124 292/25
2019/0032370 A1 * 1/2019 Perdue ..... E05B 9/08
2020/0141158 A1 * 5/2020 Kenny ..... E05B 63/006

* cited by examiner

DOOR ASSEMBLY WITH REMOVABLE LOCKBOX

CROSS-REFERENCE TO RELATED APPLICATIONS

The present application claims priority to U.S. Patent Application Ser. No. 62/939,740 filed on Nov. 25, 2019, the entire disclosure of which is incorporated herein by reference.

BACKGROUND OF THE INVENTION

The present invention relates to door assemblies and locking devices. In particular, the present invention relates to a door assembly (such as a wire partition door assembly) configured to accept various lockboxes and locking mechanisms, and which can be implemented within a larger structure to regulate access to the interior of the structure.

Wire partitions are commonly used to construct structures for objects requiring secured storage or holding. Such structures can include, but are not limited to, driver cages, controlled substance drug storage cages, server cages, holding cells, storage lockers, and technical lockers. To provide selective access to the interior of such structures, the structures typically include a door with an associated locking mechanism. Typically, the locking mechanism is carried by a lockbox that is welded to the door. Accordingly, in prior art constructions, the lockbox, which carries the locking mechanism, is a permanent fixture of the door and cannot be easily removed once installed. Furthermore, the lockbox utilized within the door is typically designed to accommodate locking mechanisms of a specific type or style. Thus, in instances where the locking requirements or functionality of the door differ from that established at the time of manufacture, the entire door must be replaced, thus resulting in increased cost to the owner. Thus, it would be desirable to provide a door assembly that permits post-manufacture modification of the lock components of the door assembly.

SUMMARY OF THE INVENTION

The present invention is a door assembly (such as a wire partition door assembly) configured to accept various lockboxes and locking mechanisms, and which can be implemented within a larger structure to regulate access to the interior of the structure.

A door assembly includes: a door with a cavity defined along an outer edge of the door; a lockbox that is positioned within the cavity and is removably secured to the door; and a locking mechanism that is carried by the lockbox. As the lockbox is removably secured to the door, the lockbox can thus readily be disconnected and disassociated from the door by authorized individuals (i.e., those individuals permitted access to the interior of the structure on which the door assembly is implemented). The lockbox also preferably includes various openings of different types, which are spaced to accommodate different types of locking mechanisms. Accordingly, the lockbox can be removed from the door to either replace the locking mechanism carried by the lockbox or to substitute the lockbox altogether to modify the locking features and/or functionality of the door assembly as desired or needed.

In some embodiments, the door is a wire partition door, including a frame and wiring that is secured to the frame, which collectively define the primary structure of the door. In some embodiments, the wiring is welded to the frame and extends from the frame in a mesh pattern. The frame includes a bracket which defines the cavity, and the lockbox is removably secured to the bracket by one or more fasteners, such that, when the door assembly is in a closed configuration, each fastener is positioned on a back side of the door that is inaccessible to unauthorized individuals located outside of the structure. To facilitate securing the lockbox to the bracket, in some embodiments, the bracket includes an upper portion, a lower portion, and a side portion, each of which define one or more openings configured to receive a fastener. The lockbox includes a plurality of edges, with each of the plurality of edges defining at least one hole corresponding to one of the openings of the bracket and configured to receive a fastener of the one or more fasteners.

In some embodiments, the lockbox includes a body, which defines a first opening for receiving mounting hardware of the locking mechanism, a second opening for receiving at least one of a handle and a lock face of the locking mechanism, and a third opening for permitting a bolt (e.g., a latch bolt or dead bolt) of the locking mechanism to transition in and out of an interior volume defined by the body.

In some embodiments, the door assembly further includes a plate that is secured to the frame and/or wiring and is positioned on a front side of the door proximal to and around the periphery of the lockbox, such that the plate covers any openings defined in the wiring to prevent tampering with the fastener(s) securing the lockbox to the bracket.

In some embodiments, the door assembly further includes a guard that is secured to the frame and/or wiring and extends outwardly from the door. The guard is positioned proximate to the cavity and the lockbox to prevent access to or manipulation of the bolt of the locking mechanism.

In another aspect, the present invention is directed to a door assembly kit, which enables users to selectively adjust the locking functionality. The kit includes: a door, including a frame and a bracket which defines a cavity along an outer edge of the door; a first lockbox configured to be positioned in the cavity and removably secured to the door by one or more fasteners, with each of the one or more fasteners positioned on a back side of the door; a first locking mechanism positioned within and carried by the first lockbox; a second lockbox configured to be positioned in the cavity and removably secured to the door by the one or more fasteners, with each of the one or more fasteners positioned on the back side of the door; and a second locking mechanism positioned within and carried by the second lockbox, the second locking mechanism differing from the first locking mechanism. The first lockbox and the second lockbox can be selectively swapped in and out of the door by engaging and disengaging the fasteners from the lockboxes to provide a door assembly that exhibits the locking functionality necessary for a structure or required at a particular time.

In some embodiments, instead of comprising two lockboxes, the kit may comprise a single lockbox which is configured to carry both the first locking mechanism and the second locking mechanism. In such embodiments, the locking function of the door assembly can thus be modified by swapping out the first locking mechanism and the second locking mechanism in and out of the lockbox.

DESCRIPTION OF THE INVENTION

The present invention relates to a door assembly (such as a wire partition door assembly) configured to accept various lockboxes and locking mechanisms, and which can be implemented within a larger structure to regulate access to the interior of the structure.

Figure 1:
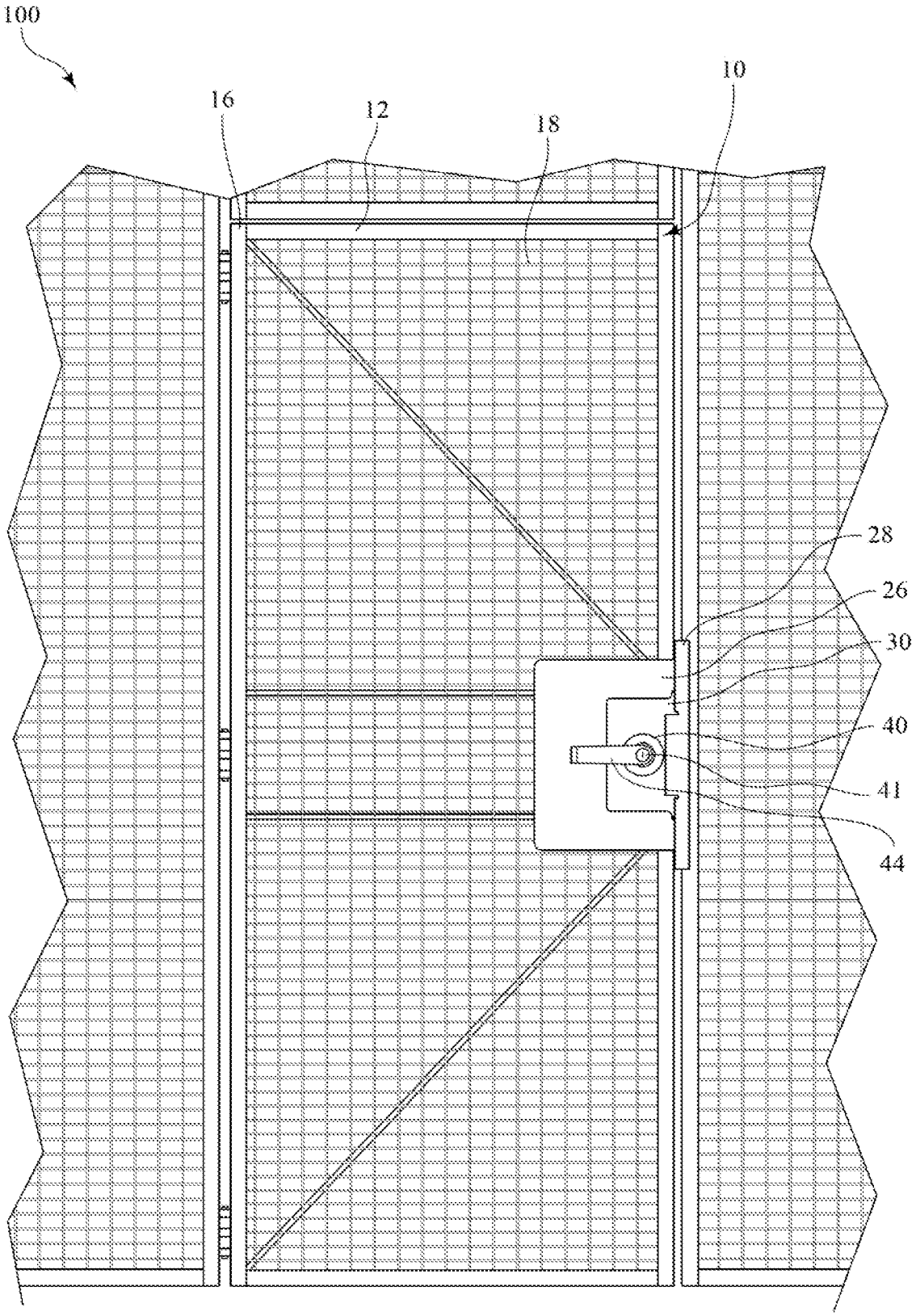
FIG. 1 is a partial view of a wire partition structure, including an exemplary door assembly made in accordance with the present invention.

FIG. 1 is a partial view of a wire partition structure 100, including an exemplary door assembly 10 made in accordance with the present invention.

Figure 2:
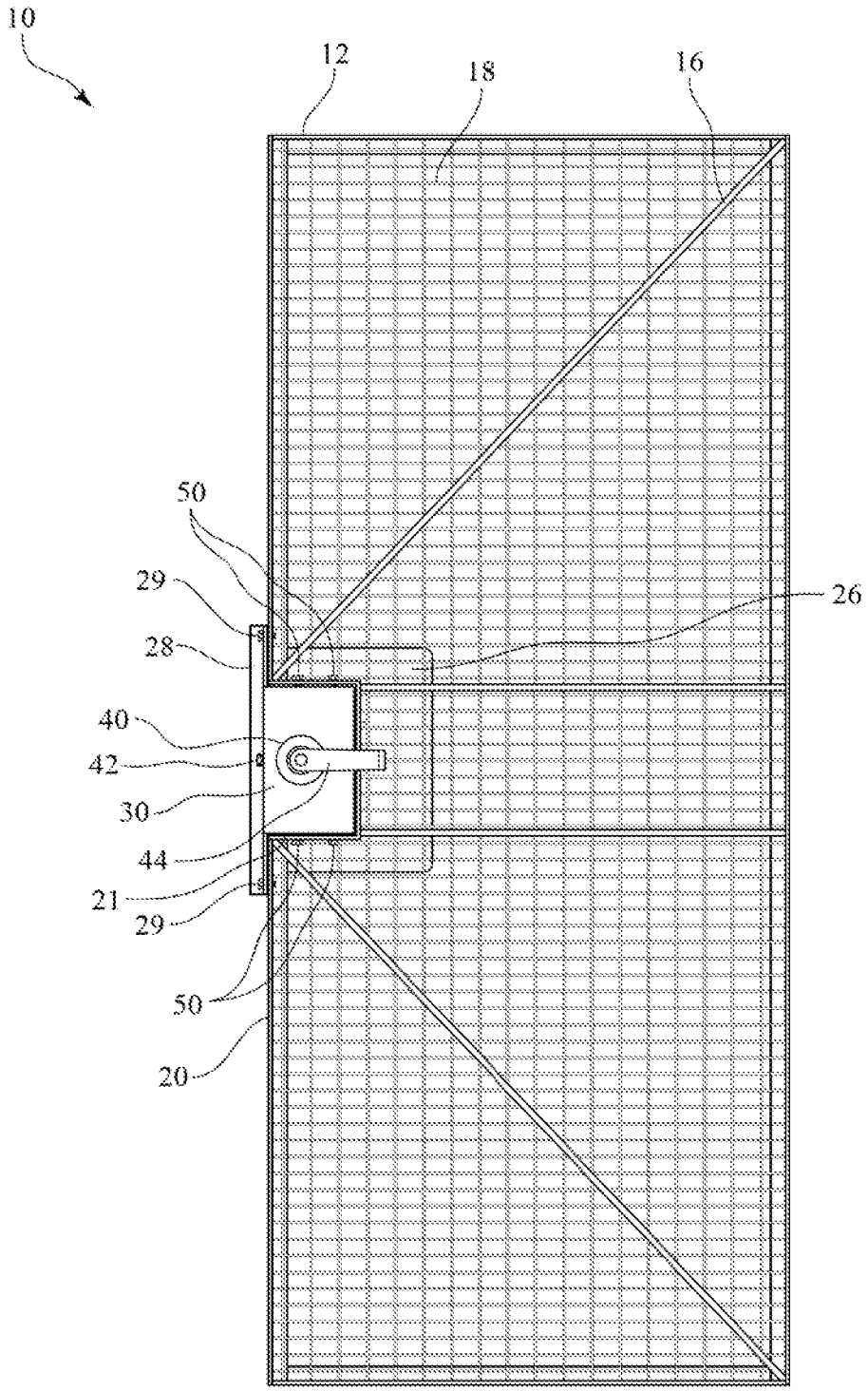
FIG. 2 is a rear view of the exemplary door assembly of FIG. 1.

FIG. 2 is a rear view of the exemplary door assembly 10 of FIG. 1.

Figure 3:
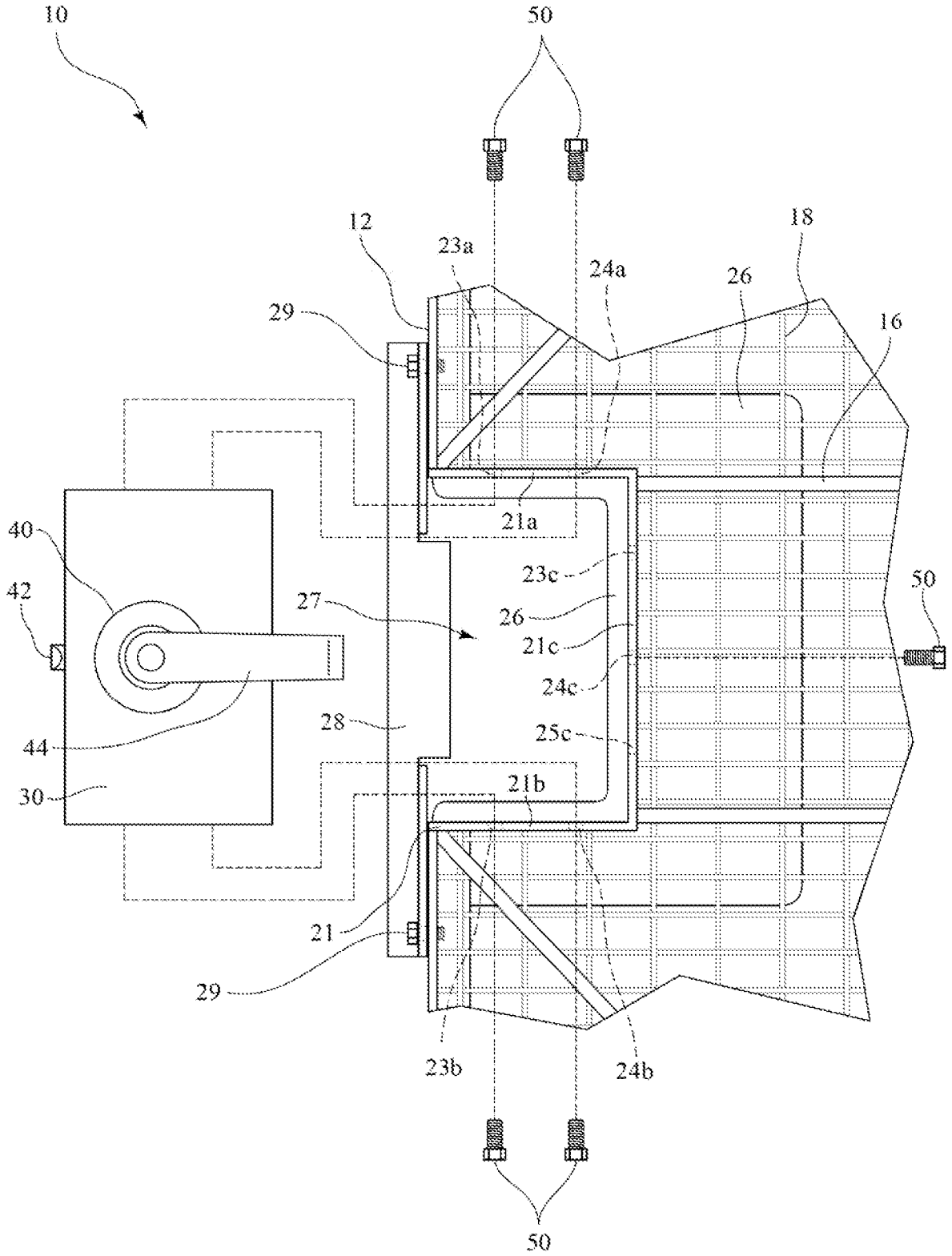
FIG. 3 is a partial exploded view of the exemplary door assembly of FIG. 1.

FIG. 3 is a partial exploded view of the exemplary door assembly 10 of FIG. 1.

Referring now to FIGS. 1-3, the door assembly 10 includes: a door 12 with a cavity 27 defined along an outer edge of the door 12; a lockbox 30 that is positioned within the cavity 27 and is removably secured to the door 12; and a locking mechanism 40 that is positioned within and carried by the lockbox 30. As shown in FIG. 1, the exemplary door assembly 10 can be implemented within a larger structure 100, which, in this case, is a wire partition structure, to regulate access to the interior of the structure 100. The lockbox 30 includes various openings of different types spaced to accommodate different types locking mechanisms, as further described below. The lockbox 30 is removably secured to the door 12 by one or more fasteners 50, so that the lockbox 30, and the locking mechanism 40 carried thereby, can readily be disconnected and disassociated from the door 12 by authorized individuals. Thus, unlike prior art constructions, where the lockbox is permanently secured to the door by welded connection and is designed to accommodate locking mechanisms of a specific type or style, the locking features and/or functionality of the door assembly 10 of the present invention can be readily modified as desired or needed.

Referring still to FIGS. 1-3, in this exemplary embodiment, the locking mechanism 40 is a lever handle locking mechanism, which includes a latch bolt 42 and a handle 44 with a keyed lock face 41 (FIG. 1). Of course, it should be appreciated that a variety of locking mechanisms could alternatively be used without departing from the spirit or scope of the present invention. For instance, in some embodiments, the locking mechanism may comprise: a mechanical lock (e.g., thumb-turn latches, door knobs, interior key locks, etc.); an electrical locking device (e.g., proximity readers, keypads, electro-magnetic locking mechanism, etc.); or combinations thereof.

Referring still to FIGS. 1-3, in this exemplary embodiment, the door 12 of the door assembly 10 includes a frame 16 and wiring 18 that is welded to the frame 16, which collectively define the primary structure of the door 12. In this exemplary embodiment, the wiring extends from the frame 16 in an overlapping grid (or mesh) pattern. In this exemplary embodiment, the door 12 is a hinged door. Of course, it should be appreciated that the door 12 could be of a different type or assume a different configuration without departing from the spirit or scope of the present invention. For instance, in some embodiments, the door may be a sliding door or a door having a window formed therein.

Referring still to FIGS. 1-3, in this exemplary embodiment, the frame 16 of the door 12 is comprised of steel angle reinforced with steel flat bar, and the wiring 18 is a 10-gauge wire that is woven into a 2"×1" rectangular mesh pattern. Of course, it should be appreciated that the wiring 18 can be of a different gauge or arranged in other patterns without departing from the spirit or scope of the present invention. Furthermore, the wiring could be replaced with sheet metal, expanded metal, or polycarbonate.

Referring now specifically to FIGS. 2 and 3, the frame 16 includes a bracket 21 positioned along an outer edge the door 12 to which the lockbox 30 is removably secured. In this regard, the bracket 21 can be integrally formed with the frame 16 or comprise a separate component which is mounted to the primary structure of the frame 16. In this exemplary embodiment, the bracket 21 defines a rectangular cavity with: an upper portion 21*a*; a lower portion 21*b* that is substantially parallel to the upper portion 21*a*; and a side portion 21*c* that is substantially perpendicular to the upper and lower portions 21*a*, 21*b*. The bracket 21 of the frame 16 defines one or more openings 23*a*, 23*b*, 23*c*, 24*a*, 24*b*, 24*c*, 25*c* (shown in dashed lines in FIGS. 3 and 5) that permit fasteners 50 to pass through the frame 16 and engage the lockbox 30. In this exemplary embodiment, there are: two such openings 23*a*, 24*a* defined through the upper portion 21*a* of the bracket 21; two such openings 23*b*, 24*b* defined through the lower portion 21*b* of the bracket 21; and three such openings 23*c*, 24*c*, 25*c* defined through the side portion 21*c* of the bracket 21. As shown, in this exemplary embodiment, the lockbox 30 is removably secured to the door 12 by five fasteners 50 corresponding to the openings 23*a*, 24*a* defined through the upper portion 21*a* of the bracket 21, the openings 23*b*, 24*b* defined through the lower portion 21*b* of the bracket 21, and one of the openings 24*c* defined through the side portion 21*c* of the bracket 21. In any event, the lockbox 30 may be secured to the door 12 using some or all of the openings 23*a*, 23*b*, 23*c*, 24*a*, 24*b*, 24*c*, 25*c* of the bracket 21. Additionally, it is appreciated that fewer or more openings, or openings in alternate configurations, could be defined by the bracket 21 without departing from the spirit and scope of the present invention.

In this exemplary embodiment, the fasteners 50 are threaded bolts. Of course, fewer than or greater than five fasteners 50 and alternative fasteners suitable for removably securing the lockbox 30 to the door 12 could be utilized without departing from the spirit and scope of the present invention.

Referring now again to FIGS. 1-3, to prevent unauthorized individuals from accessing the fasteners 50, the bracket 21 is located on the back side of the door 12, which, when in a closed configuration, faces the interior of the structure 100 to which the door assembly 10 is installed. To this end, the door 12 further includes a plate 26 that is secured to the frame 16 and/or wiring 18 and positioned on the front side of the door 12 proximal to and around the periphery of the lockbox 30, such that the plate 26 covers the openings defined in the wiring 18 located proximate to the lockbox 30 to prevent tampering with the fasteners 50. In this exemplary embodiment, the plate 26 is welded to the wiring 18 and is thus permanently secured to the front side of the door 12.

Referring still to FIGS. 1-3, as noted above, the bracket 21 of the frame 16 defines the cavity 27, which, in this exemplary embodiment, is along a lateral edge of the door 12, and in which the lockbox 30 is positioned. Specifically, in this exemplary embodiment, the cavity 27 is the rectangular cavity defined by the upper portion 21*a*, lower portion 21*b*, and side portion 21*c* of the bracket 21. The cavity 27 is of sufficient dimension to accommodate multiple standard-sized lockboxes. In this exemplary embodiment, the bracket 21 is sized and shaped so that the cavity 27 is of sufficient size to accommodate a lockbox 30 with a width of approximately six inches, a height of approximately ten inches, and a depth of approximately one and three-fourths inches. Of course, one of ordinary skill in the art will readily appreciate the dimensions of the bracket 21, and thus the cavity 27, could be adjusted to accommodate lockboxes of different dimensions. Furthermore, it is contemplated that spacers could be interposed between the bracket 21 and a lockbox 30 of a smaller size so that it is properly fitted into the cavity 27.

Figure 4A:
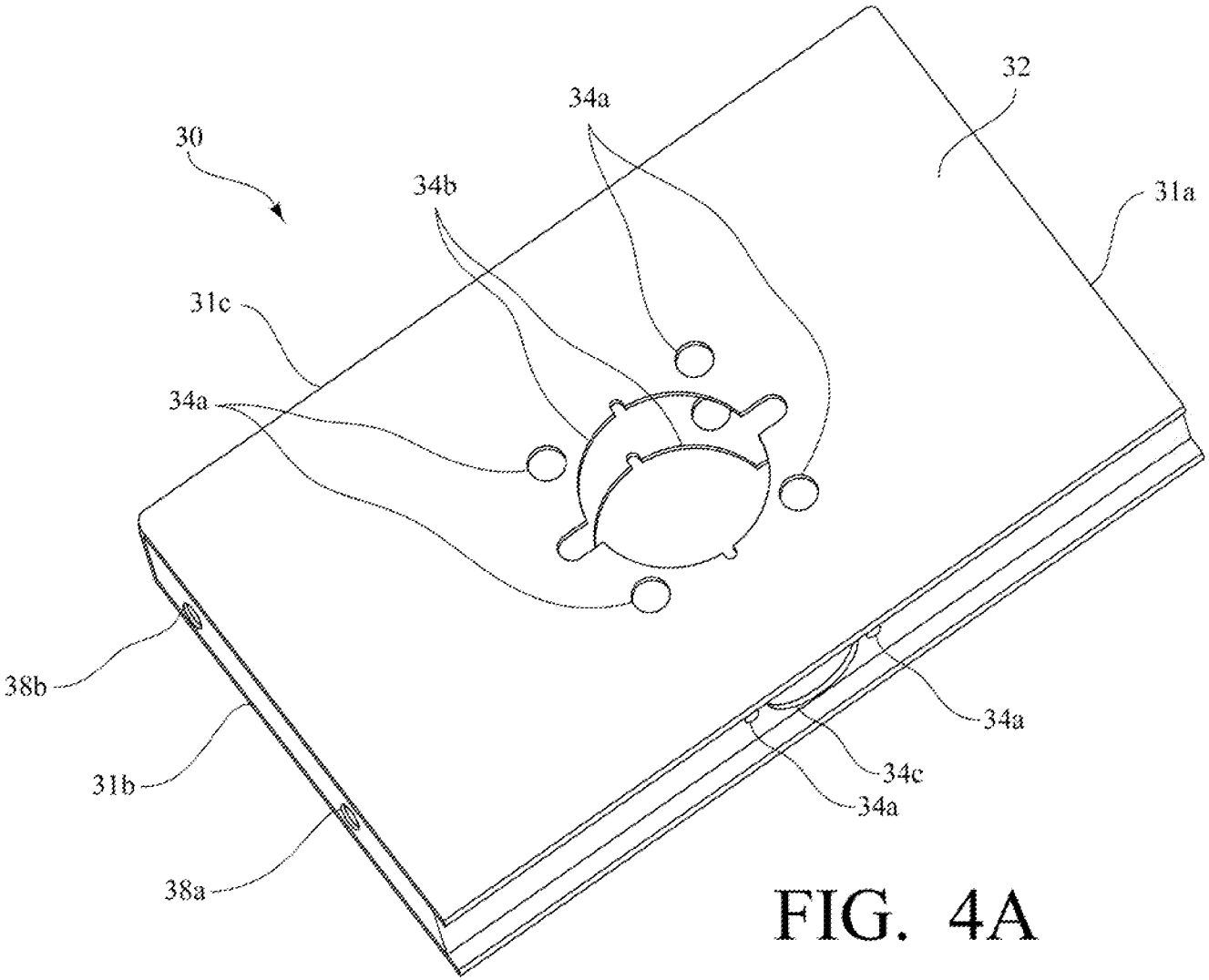
FIG. 4A is a perspective view of the lockbox of the exemplary door assembly of FIG. 1.

FIG. 4A is a perspective view of the lockbox 30 of the exemplary door assembly 10 of FIG. 1.

Figure 4B:
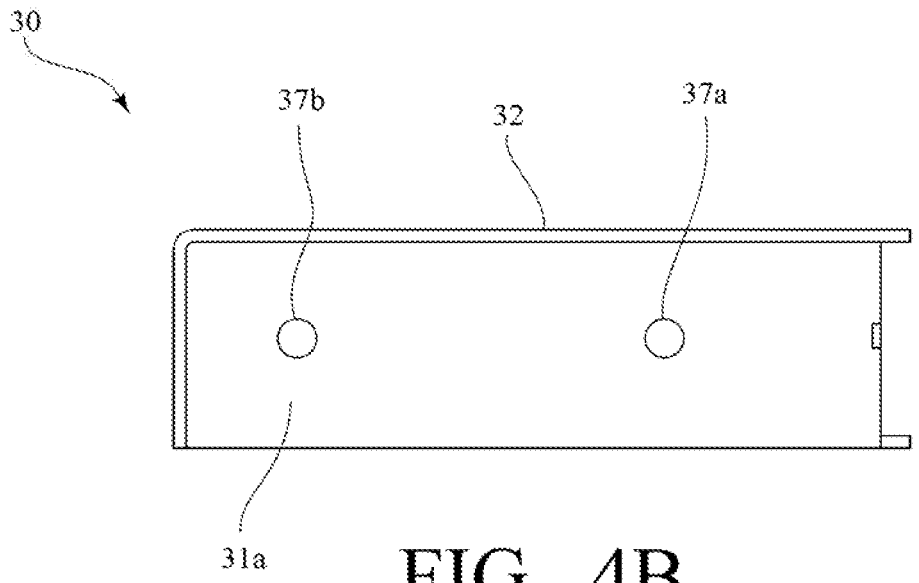
FIG. 4B is a top view of the lockbox of FIG. 4A.

FIG. 4B is a top view of the lockbox of FIG. 4A.

Figure 4C:
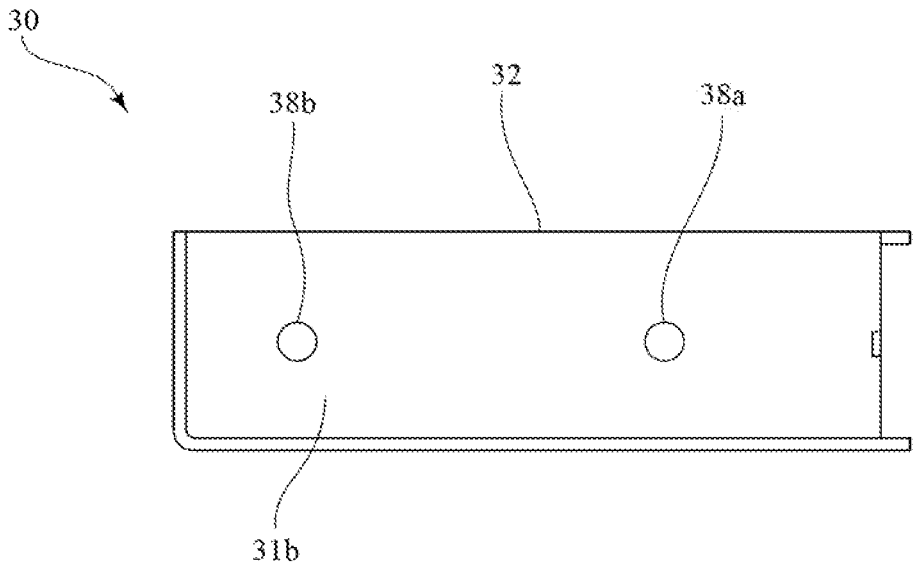
FIG. 4C is a bottom view of the lockbox of FIG. 4A.

FIG. 4C is a bottom view of the lockbox of FIG. 4A.

Figure 4D:
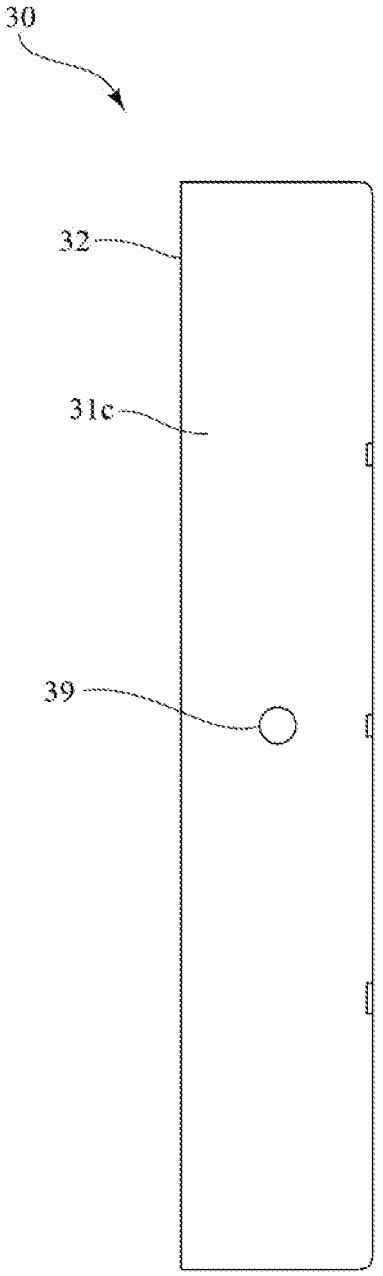
FIG. 4D is a left side view of the lockbox of FIG. 4A.

FIG. 4D is a left side view of the lockbox of FIG. 4A.

Figure 4E:
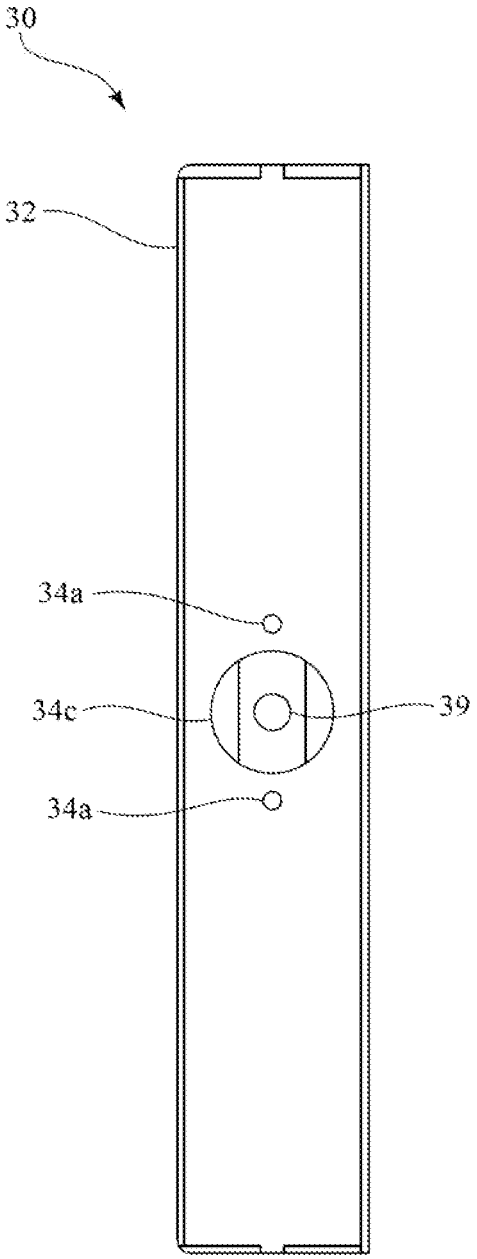
FIG. 4E is a right side view of the lockbox of FIG. 4A.

FIG. 4E is a right side view of the lockbox of FIG. 4A.

Referring now to FIGS. 4A, 4B, 4C, 4D, and 4E, the lockbox 30 is configured to accept and carry a variety of different locking mechanisms. To this end, the lockbox 30 includes a body 32 having a plurality of openings 34*a*, 34*b*, 34*c* defined therein which are configured to receive and permit operation of the various components of a locking mechanism 40. In this exemplary embodiment, the lockbox 30 includes three different types of openings: first openings 34*a* configured to receive the mounting or fasteners of the locking mechanism 40; second openings 34*b* configured to receive the handle and/or lock face of the locking mechanism 40; and a third opening 34*c* configured to permit the latch bolt 42 and/or dead bolt of the locking mechanism 40 to transition in and out of an interior volume defined by the body 32 of the lockbox 30 when transitioning the locking mechanism 40 between a locked and unlocked configuration. As best shown in FIG. 4A, in this exemplary embodiment, the lockbox 30 includes four first openings 34*a* which are radially positioned about the second opening 34*b*, and two more first openings 34*a* that are positioned adjacent to the third opening 34*c*. As best shown in FIG. 4A, in this exemplary embodiment, the second opening 34*b* and each of the four first openings 34*a* radially positioned about the second opening 34*b* are defined within two opposing plates of the body 32 of the lockbox 30. (In this exemplary embodiment, the lockbox 30 actually has front and rear faces separated by an internal volume; for the purposes of this description, corresponding openings within the front and rear faces are characterized as a single opening.) The respective openings 34*a*, 34*b*, 34*c* are sized and spaced to accommodate the various lock components of different locking mechanism types and styles. Accordingly, in use, some or all of the openings 34*a*, 34*b*, 34*c* may be utilized, depending on what type of locking mechanism is used.

Referring still to FIGS. 4A-4E, three edges 31*a*, 31*b*, 31*c* of the body 32 of the lockbox 30 further define a plurality of holes 37*a*, 37*b*, 38*a*, 38*b*, 39 which are configured to receive the fasteners 50 passing through the openings 23*a*, 23*b*, 24*a*, 24*b*, 24*c* defined in the bracket 21 of the frame 16. Accordingly, in this exemplary embodiment, a plurality of edges 31*a*, 31*b*, 31*c*, but not all of the edges, of the body 32 of the lockbox 30 define holes 37*a*, 37*b*, 38*a*, 38*b*, 39 configured to receive the fasteners 50. Specifically, in this exemplary embodiment, an upper edge 31*a* of the body 32 defines two holes 37*a*, 37*b* corresponding to openings 23*a* and 23*b* of the bracket 21. A lower edge 31*b* of the body 32 defines two holes 38*a*, 38*b* corresponding to openings 23*b*, 24*b* of the bracket 21. A side edge 31*c* of the body 32 defines a single hole 39 corresponding to opening 24*c* of the bracket 21. Again, however, fewer or more holes, or holes in alternate configurations, could be defined by the body 32 of the lockbox 30 without departing from the spirit and scope of the present invention. To facilitate engagement of the fasteners 50 with the lockbox 30, the fasteners 50 and the portions of the body 32 of the lockbox 30 defining the holes 37*a*, 37*b*, 38*a*, 38*b*, 39 are preferably threaded.

Referring now to FIGS. 1-3, and 4A-4E, to assemble the door assembly 10, the various components of the locking mechanism 40 are assembled within the lockbox 30, at least in part, by positioning the various lock components of the locking mechanism 40 within or adjacent to the corresponding openings 34*a*, 34*b*, 34*c* defined within the body 32 of the lockbox 30. The lockbox 30 is inserted into the cavity 27 of the door 12 and positioned so that the holes 37*a*, 37*b*, 38*a*, 38*b*, 39 defined within the lockbox 30 are aligned with corresponding openings 23*a*, 23*b*, 24*a*, 24*b*, 24*c* defined in the bracket 21 of the frame 16 located on the back side of the door 12. Once the holes 37*a*, 37*b*, 38*a*, 38*b*, 39 of the lockbox 30 are aligned with the corresponding openings 23*a*, 23*b*, 24*a*, 24*b*, 24*c* within the bracket 21, the fasteners 50 are inserted to engage and secure the lockbox 30 within the cavity 27 of the door 12.

In the event that a different lockbox 30 or locking mechanism 40 is needed for the structure 100 in which the door assembly 10 is implemented, the lockbox 30 can be easily removed from the door 12 by disengaging the fasteners 50 from the lockbox 30. However, because the bracket 21 of the frame 16 is located on the back side of the door 12, and the plate 26 secured to the front of the door 12 covers the openings defined in the wiring 18 located proximate to the lockbox 30, when the door assembly 10 is in a closed configuration, the fasteners 50 are inaccessible to unauthorized individuals located outside of the structure to which the door assembly 10 is installed. In this way, once the door assembly 10 is assembled and installed in the structure 100 and is placed in a locked configuration, the ability to remove the lockbox 30 from the door 12 is effectively limited to those individuals authorized to access the interior of the structure 100 (i.e., those individuals able to unlock the door assembly 10). Once the lockbox 30 is removed, the locking mechanism 40 carried by the lockbox 30 can be replaced, or the lockbox 30 can be substituted altogether. The lockbox 30 carrying the new locking mechanism or the substitute lockbox can be reinstalled within the opening of the door 12 to provide the door assembly 10 with the requisite locking functionality.

Referring now again to FIGS. 1-3, in this exemplary embodiment, the door assembly 10 further includes an optional guard 28 that is secured to the frame and/or wiring and extends outwardly from the door 12. The guard 28 is positioned proximate to the cavity 27 and the lockbox 30, such that, when the door assembly 10 is hung within the door frame of a structure, the space between the door frame and the door assembly 10 located proximate to the lockbox 30 and locking mechanism 40 is covered from the exterior of the structure 100 (i.e., on the front side of the door assembly 10) by the guard 28, thereby preventing access to or manipulation of the latch bolt 42 or dead bolt of the locking mechanism 40. In this exemplary embodiment, the guard 28 is removably secured to the door 12 via two fasteners 29. In alternative embodiments, the guard 28 may be permanently secured to the door 12 via a welded connection.

Figure 5:
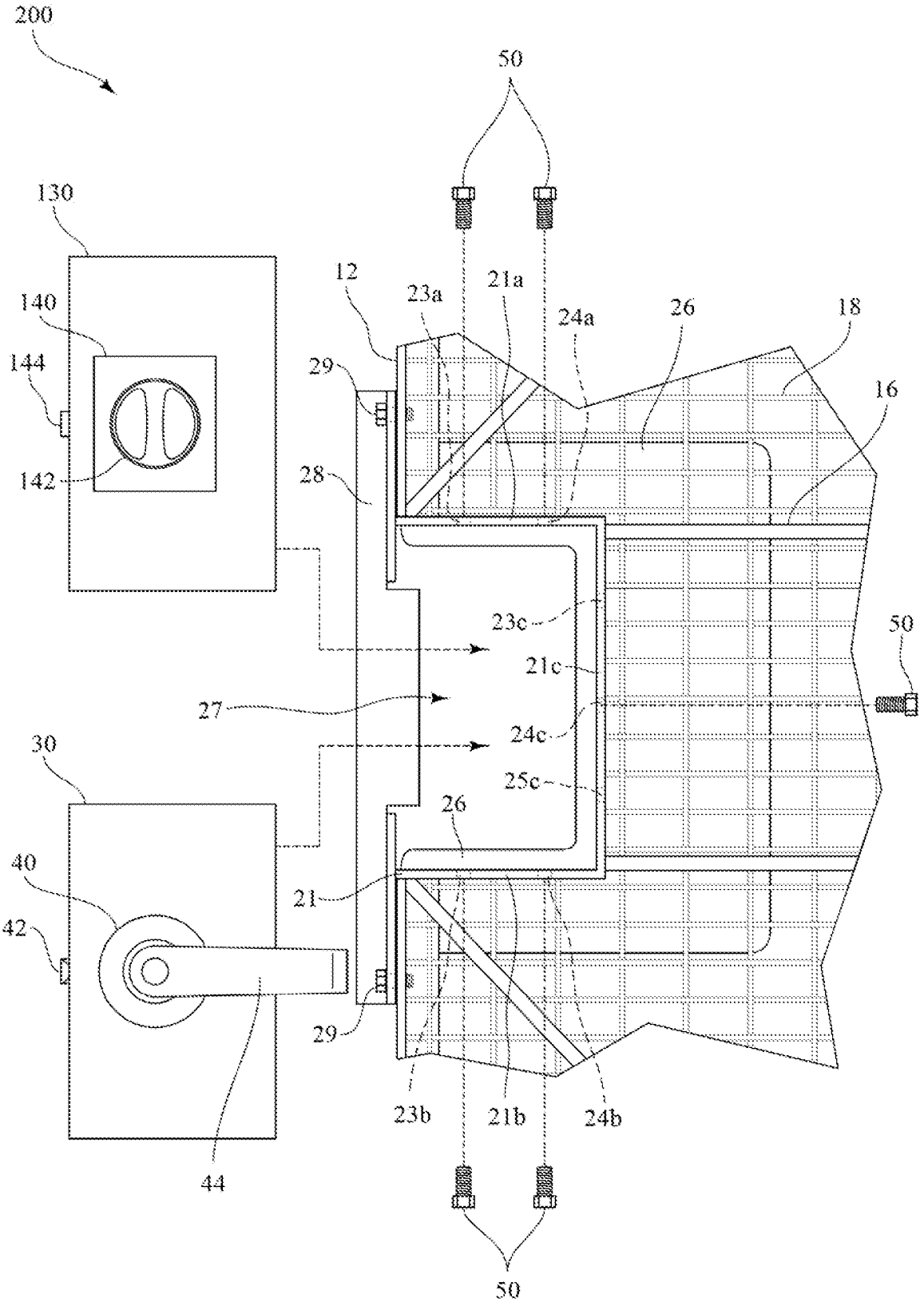
FIG. 5 illustrates an exemplary door assembly kit made in accordance with the present invention.

FIG. 5 illustrates an exemplary door assembly kit 200 made in accordance with the present invention, which enables users to selectively adjust the locking functionality. The kit 200 includes the above-described door assembly 10. In this regard, like components are provided with like reference numerals throughout the present application. The kit 200 further includes a second lockbox 130 carrying a second locking mechanism 140. Like the lockbox 30 described above for the door assembly 10 (i.e., the "first lockbox"), the second lockbox 130 is similarly configured to be positioned in the cavity 27 and secured to the bracket 21 of the door 12 using the fasteners 50. In this exemplary embodiment, a second locking mechanism 140 carried by the second lockbox 130 differs from the locking mechanism 40 (i.e., the "first locking mechanism") carried by the first lockbox 30. Specifically, in this exemplary embodiment, the first locking mechanism 40 carried by the first lockbox 30 is a lever handle locking mechanism including a latch bolt 42 and a handle 44, while the second locking mechanism 140 carried by the second lockbox 130 is defined by a key lock 142 (the back side of which is shown in FIG. 5) and a dead bolt 144. Of course, the first locking mechanism 40 carried by the first lockbox 30 and the second locking mechanism 140 carried by the second lockbox 130 could be any of a variety of locking mechanisms without departing from the spirit or scope of the present invention.

Referring still to FIG. 5, the first lockbox 30 and the second lockbox 130 can be selectively swapped in and out of the door 12 by engaging and disengaging the fasteners 50 from the lockboxes 30, 130 to provide a door assembly 10 that exhibits the locking functionality necessary for a structure or required at a particular time. In some embodiments, instead of comprising two lockboxes 30, 130, the kit 200 may comprise a single lockbox which is configured to carry both the first locking mechanism 40 and the second locking mechanism 140. In such embodiments, the locking function of the door assembly can thus be modified by swapping out the first locking mechanism 40 and the second locking mechanism 140 in and out of the lockbox.

One of ordinary skill in the art will recognize that additional embodiments are also possible without departing from the teachings of the present invention. This detailed description, and particularly the specific details of the exemplary embodiments disclosed herein, are given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A door assembly, comprising:

a door, including a frame and a bracket which defines a cavity along an outer edge of the door; and a lockbox configured to carry a locking mechanism, the lockbox being selectively positioned within the cavity along the outer edge of the door, wherein the lockbox is removably secured to the bracket by one or more fasteners, with each of the one or more fasteners positioned on a back side of the door;

wherein the bracket includes an upper portion, a lower portion that is parallel to the upper portion, and a side portion that is perpendicular to the upper portion and the lower portion;

wherein the upper portion of the bracket, the lower portion of the bracket, and the side portion of the bracket each define an opening; and wherein the lockbox includes a top edge and a bottom edge, with the top edge of the lockbox defining a hole corresponding to the opening defined by the upper portion of the bracket and configured to receive a fastener of the one or more fasteners, and with the bottom edge of the lockbox defining a hole corresponding to the opening defined by the lower portion of the bracket and configured to receive another fastener of the one or more fasteners.

2. The door assembly as recited in claim 1, wherein the door further includes wiring that is welded to the frame and extends from the frame in a mesh pattern.

3. The door assembly as recited in claim 2, wherein the door further includes a plate positioned proximal to and around a periphery of the lockbox and secured to at least one of the frame and the wiring on a front side of the door.

4. The door assembly as recited in claim 2, wherein the door further includes a guard that is secured to at least one of the frame and the wiring, and is positioned proximate to the cavity and the lockbox.

5. The door assembly as recited claim 1, wherein the lockbox includes a body defining a first opening for receiving mounting hardware of the locking mechanism, a second opening for receiving at least one of a handle and a lock face of the locking mechanism, and a third opening for permitting a bolt of the locking mechanism to transition in and out of an interior volume defined by the body.

6. A door assembly, comprising:

a door, including a frame and a bracket which defines a cavity along an outer edge of the door;

a lockbox selectively positioned within the cavity along the outer edge of the door, wherein the lockbox is removably secured to the bracket by one or more fasteners, with each of the one or more fasteners positioned on a back side of the door; and a locking mechanism positioned within and carried by the lockbox;

wherein the bracket includes an upper portion, a lower portion that is parallel to the upper portion, and a side portion that is perpendicular to the upper portion and the lower portion;

wherein the upper portion of the bracket, the lower portion of the bracket, and the side portion of the bracket each define an opening; and wherein the lockbox includes a top edge and a bottom edge, with the top edge of the lockbox defining a hole corresponding to the opening defined by the upper portion of the bracket and configured to receive a fastener of the one or more fasteners, and with the bottom edge of the lockbox defining a hole corresponding to the opening defined by the lower portion of the bracket and configured to receive another fastener of the one or more fasteners.

7. The door assembly as recited in claim 6, wherein the door further includes wiring that is welded to the frame and extends from the frame in a mesh pattern.

8. The door assembly as recited in claim 7, wherein the door further includes a plate positioned proximal to and around a periphery of the lockbox and secured to at least one of the frame and the wiring on a front side of the door.

9. The door assembly as recited in claim 7, wherein the door further includes a guard that is secured to at least one of the frame and the wiring on the front side of the door, and is positioned proximate to the cavity and the lockbox.

10. The door assembly as recited in claim 6, wherein the lockbox includes a body defining a first opening for receiving mounting hardware of the locking mechanism, a second opening for receiving at least one of a handle and a lock face of the locking mechanism, and a third opening for permitting a bolt of the locking mechanism to transition in and out of an interior volume defined by the body.

11. A door assembly kit, comprising:

a door, including a frame and a bracket which defines a cavity along an outer edge of the door;

a first lockbox configured to be positioned in the cavity and removably secured to the door by one or more fasteners, with each of the one or more fasteners positioned on a back side of the door;

a first locking mechanism positioned within and carried by the first lockbox;

a second lockbox configured to be positioned in the cavity and removably secured to the door by the one or more fasteners, with each of the one or more fasteners positioned on the back side of the door; and a second locking mechanism positioned within and carried by the second lockbox, the second locking mechanism differing from the first locking mechanism; and wherein the bracket includes an upper portion, a lower portion that is parallel to the upper portion, and a side portion that is perpendicular to the upper portion and the lower portion;

wherein the upper portion of the bracket, the lower portion of the bracket, and the side portion of the bracket each define an opening; and wherein the first lockbox and the second lockbox each include a plurality of edges, with one or more of the plurality of edges defining at least one hole corresponding to one of the openings of the bracket and configured to receive a fastener of the one or more fasteners.

12. The door assembly kit as recited in claim 11, wherein the door further includes wiring that is welded to the frame and extends from the frame in a mesh pattern.

13. The door assembly kit as recited in claim 12, wherein the door further includes a plate positioned proximal to and around a periphery of the first lockbox or the second lockbox and secured to at least one of the frame and the wiring on a front side of the door.

14. The door assembly kit as recited in claim 11, wherein the first lockbox and the second lockbox each include a body defining a first opening for receiving mounting hardware of a locking mechanism, a second opening for receiving at least one of a handle and a lock face of the locking mechanism, and a third opening for permitting a bolt of the locking mechanism to transition in and out of an interior volume defined by the body.

15. A door assembly kit, comprising a door, including a frame and a bracket which defines a cavity along an outer edge of the door;

a first lockbox configured to be positioned in the cavity and removably secured to the door by one or more fasteners, with each of the one or more fasteners positioned on a back side of the door;

a first locking mechanism positioned within and carried by the first lockbox;

a second lockbox configured to be positioned in the cavity and removably secured to the door by the one or more fasteners, with each of the one or more fasteners positioned on the back side of the door; and a second locking mechanism positioned within and carried by the second lockbox, the second locking mechanism differing from the first locking mechanism;

wherein the first lockbox and the second lockbox each include a top edge and a bottom edge, with the top edge of the first lockbox and the top edge of the second lockbox each defining a hole corresponding to the opening defined by the upper portion of the bracket, and with the bottom edge of the first lockbox and the second lockbox each defining a hole corresponding to the opening defined by the lower portion of the bracket.

16. The door assembly kit as recited in claim 15, wherein the door further includes wiring that is welded to the frame and extends from the frame in a mesh pattern.

17. The door assembly kit as recited in claim 16, wherein the door further includes a plate positioned proximal to and around a periphery of the first lockbox or the second lockbox and secured to at least one of the frame and the wiring on a front side of the door.

18. The door assembly kit as recited in claim 15, wherein the first lockbox and the second lockbox each include a body defining a first opening for receiving mounting hardware of a locking mechanism, a second opening for receiving at least one of a handle and a lock face of the locking mechanism, and a third opening for permitting a bolt of the locking mechanism to transition in and out of an interior volume defined by the body.

* * * * *